US008511083B2

(12) United States Patent
Arnold et al.

(10) Patent No.: US 8,511,083 B2
(45) Date of Patent: Aug. 20, 2013

(54) PORTED SHROUD WITH FILTERED EXTERNAL VENTILATION

(75) Inventors: Steven Don Arnold, Ranch Palos Verdes, CA (US); David A. Calta, Newbury Park, CA (US)

(73) Assignee: Honeywell International, Inc., Morristown, NJ (US)

( * ) Notice: Subject to any disclaimer, the term of this patent is extended or adjusted under 35 U.S.C. 154(b) by 1208 days.

(21) Appl. No.: 11/304,376

(22) Filed: Dec. 15, 2005

(65) Prior Publication Data

US 2007/0137201 A1 Jun. 21, 2007

(51) Int. Cl.
*F02D 23/00* (2006.01)
*F02B 33/44* (2006.01)

(52) U.S. Cl.
USPC ..... 60/602; 60/598

(58) Field of Classification Search
USPC ..... 60/598, 602; 123/559.1, 559.2, 123/559.3
See application file for complete search history.

(56) References Cited

U.S. PATENT DOCUMENTS

| | | | | |
|---|---|---|---|---|
| 3,462,071 | A * | 8/1969 | Alexander | 415/116 |
| 3,887,295 | A * | 6/1975 | Yu | 415/116 |
| 4,479,755 | A * | 10/1984 | Skoe | 415/1 |
| 4,658,798 | A * | 4/1987 | Yogo et al. | 123/559.1 |
| 4,743,161 | A | 5/1988 | Fisher et al. | |
| 4,930,978 | A * | 6/1990 | Khanna et al. | 415/58.3 |
| 4,930,979 | A | 6/1990 | Fisher et al. | |
| 5,236,301 | A * | 8/1993 | Palmer | 415/116 |
| 5,246,335 | A * | 9/1993 | Mitsubori et al. | 415/58.3 |
| 6,123,061 | A * | 9/2000 | Baker et al. | 123/573 |
| 6,699,008 | B2 * | 3/2004 | Japikse | 415/58.4 |
| 6,932,563 | B2 * | 8/2005 | Cabrales et al. | 415/58.4 |
| 7,025,557 | B2 * | 4/2006 | Japikse et al. | 415/1 |
| 2002/0192073 | A1 | 12/2002 | Japikse | |

FOREIGN PATENT DOCUMENTS

| | | |
|---|---|---|
| DE | 4213047 | 10/1993 |
| EP | 1143149 | 3/2001 |
| EP | 1128070 | 8/2001 |
| EP | 1473465 | 3/2004 |

OTHER PUBLICATIONS

PCTISRWO, PC, May 7, 2007, Honeywell.

* cited by examiner

*Primary Examiner* — Mary A Davis
(74) *Attorney, Agent, or Firm* — The Law Office of John A. Griecci

(57) ABSTRACT

A turbocharger system having a compressor wheel including blades that define an inducer and an exducer, a compressor housing configured to receive the compressor wheel, and an impeller passage within which air is to be compressed by the blades, wherein the compressor housing forms an intake port configured to provide intake air to the inducer, and a bypass port opening into the impeller passage between the inducer and exducer. The bypass port places the impeller passage in fluid communication with the atmosphere without having a fluid interaction with the intake air. A bypass-air filter is adapted to filter air passing between the bypass port and the atmosphere, and is a portion of the intake-air filter.

25 Claims, 5 Drawing Sheets

PORTED SHROUD WITH FILTERED EXTERNAL VENTILATION

The present invention relates generally to compressors for turbomachinery and, more particularly, to apparatus and methods of ventilating a compressor chamber.

BACKGROUND OF THE INVENTION

Rotary compressors are used in a variety of applications for compressing gases. As an example, with reference to FIG. 1, in turbochargers a rotating compressor wheel 11 within a compressor housing 13 sucks air through an intake port 15, compresses it in an impeller passage 17, and diffuses it into a volute 19. The compressed air is supplied to an intake manifold of an internal combustion engine. The operating range of a compressor extends from a surge condition, occurring at low airflow rates, to a choke condition experienced at high airflow rates. "Surging" occurs when a compressor operates at a relatively low flow rate with respect to the compressor pressure ratio, and the resulting flow of air throughout the compressor becomes unstable. "Choking" occurs when a compressor operates at a high flow rate that exceeds the mass flow rate available through the limited area of the intake end of the compressor wheel (known as the inducer) through which air arrives at the compressor wheel.

In order to improve the operating flow range, some compressors include one or more bypass ports 21 (such as in the form of an annular opening) on a compressor housing inner wall 23 (also referred to as a shroud) of the impeller passage 17 surrounding the compressor wheel 11. This "ported shroud" forms a shroud passageway 25 that extends between the bypass port(s) and a substantially annular opening 27 into the intake port 15 that feeds air in to the impeller passage. The ported shroud thus creates a second passageway connecting the intake port to the impeller passage, wherein this second passageway does not extend through the inducer.

The ported shroud typically improves the surge characteristics of a compressor by rerouting some air passing through the impeller passage back to the intake port during low-airflow operation, thereby extending the range over which the compressor can operate without experiencing a surge condition. The ported shroud may improve the choke characteristics of a compressor by providing an additional flow path into the impeller passage, without passing through the inducer, during high-airflow operation, thereby extending the range over which the compressor can operate without experiencing a choke condition.

While a ported shroud extends the operating range of a compressor, it also creates a systemic inefficiency. More particularly, the recirculated air that flows back to the intake port through the second passageway has been worked on by compressor wheel blades, and has been heated by the work done upon it. This heated recirculation flow increases the temperature of air entering the inducer, increasing the work needed from the turbine to compress the air, and thereby reducing the compressor efficiency.

Accordingly, there has existed a need for an apparatus and related methods to extend the flow range of a compressor without introducing significant inefficiencies from recirculated bypass air. Moreover, it is preferable that such apparatus are cost and weight efficient. Preferred embodiments of the present invention satisfy these and other needs, and provide further related advantages.

SUMMARY OF THE INVENTION

In various embodiments, the present invention solves some or all of the needs mentioned above, typically providing a turbocharger system that can extend the flow range of a compressor without introducing significant inefficiencies from recirculated bypass air.

The invention typically provides a turbocharger system having a compressor wheel including blades that define an inducer and an exducer. A compressor housing is configured to receive the compressor wheel, and defines an impeller passage within which air is to be compressed by the blades. The compressor housing has an intake port configured to provide intake air to the inducer, and a bypass port opening into the impeller passage between the inducer and exducer. The bypass port places the impeller passage in fluid communication with the atmosphere without having a fluid interaction with the intake air. Advantageously, the bypass port provides for an extended compressor flow range without introducing significant inefficiencies from recirculated bypass air.

The invention typically further features a filter adapted to filter air passing between the bypass port and the atmosphere. This bypass-air filter may be unitary with an intake-air filter, which is contained in a housing configured to operably isolate these two portions of the filter to operate as two separate filters. Advantageously, such a configuration reduces the cost of construction and maintenance.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

DETAILED DESCRIPTION OF THE PREFERRED EMBODIMENTS

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a vented compressor housing for a turbocharger, along with associated methods and apparatus. Preferred embodiments of the invention are assemblies that provide for filtered venting of an impeller passage in which a compressor wheel rotates.

Figure 1:
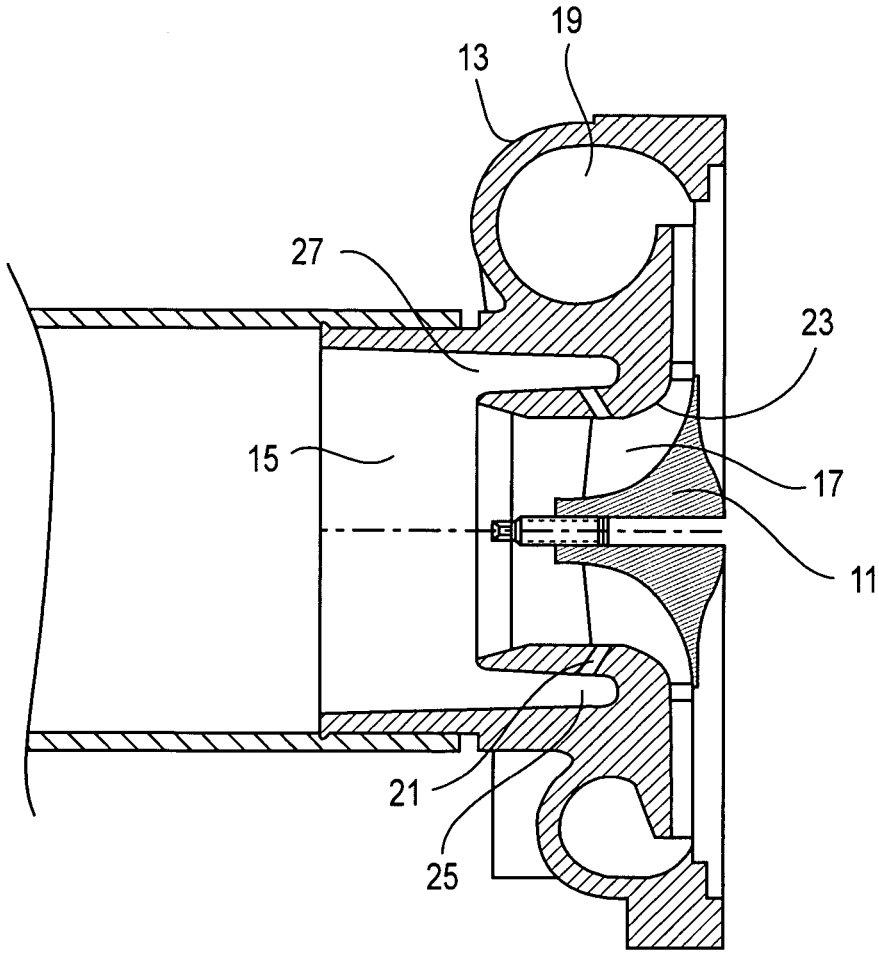
FIG. 1 PRIOR ART
FIG. 1 is a cross-section of a Prior Art compressor housing.
Figure 2:
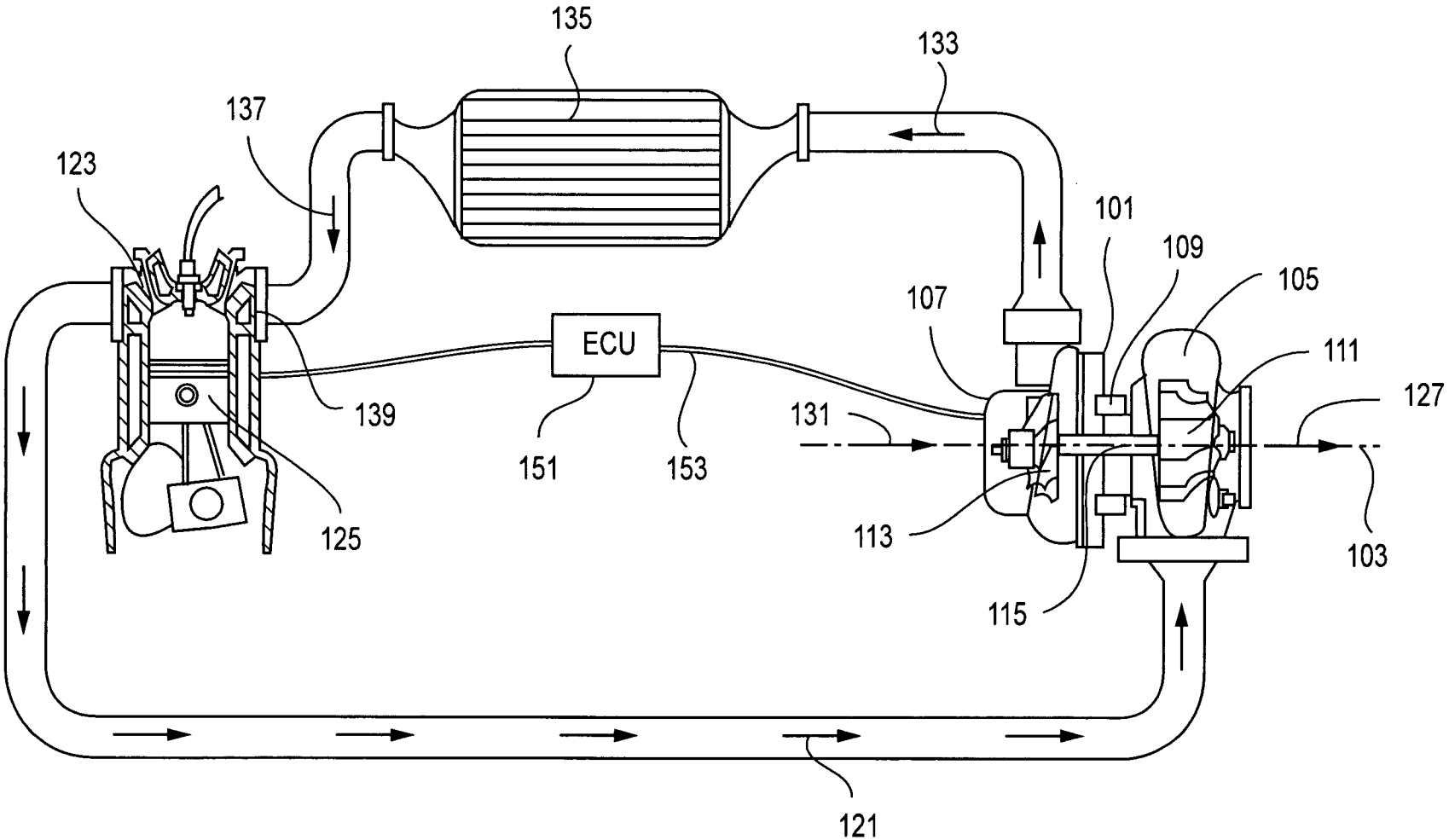
FIG. 2 is a system layout of an internal combustion engine with a turbocharger and a charge air cooler under the present invention.
Figure 3:
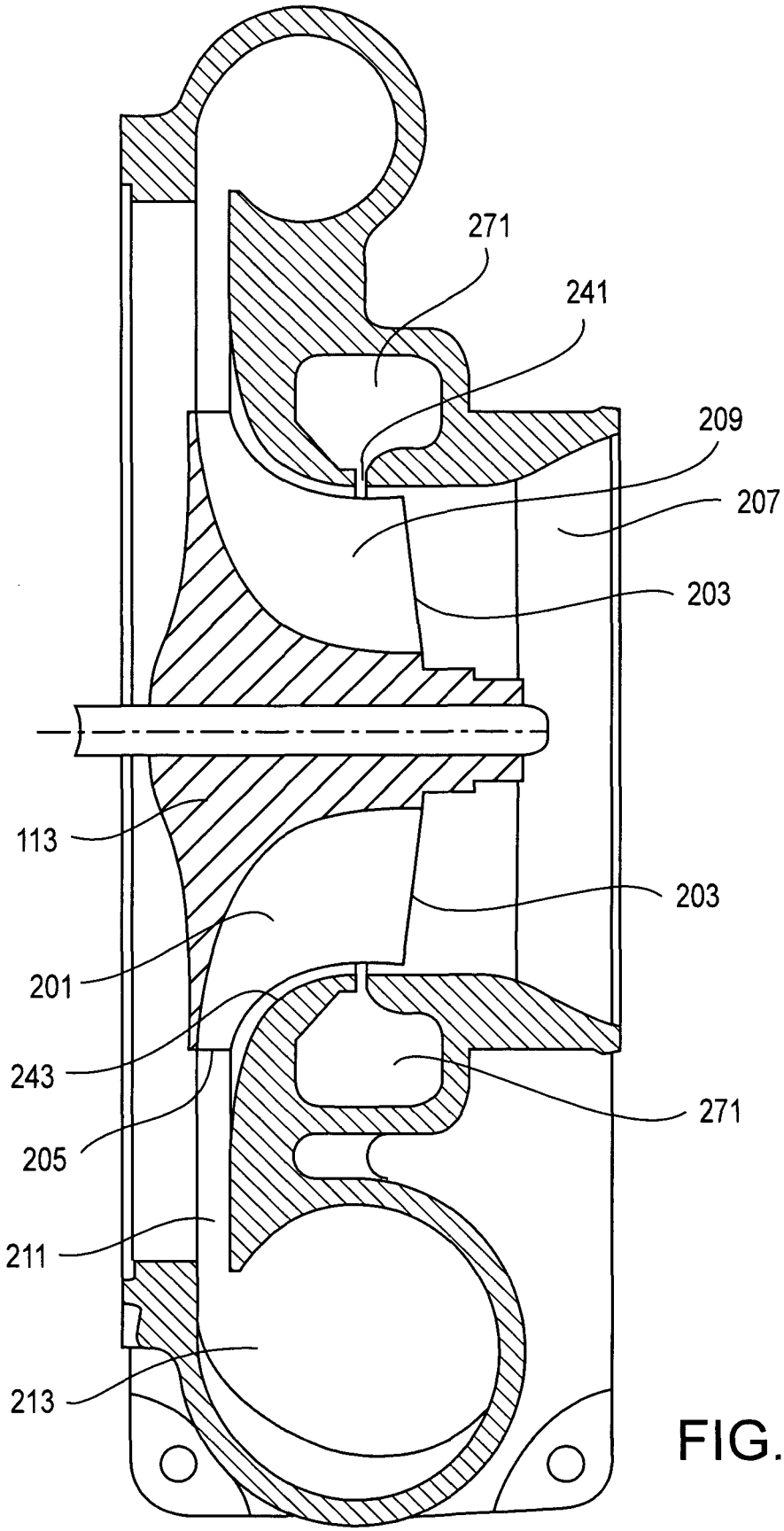
FIG. 3 is a front cross-section view of a compressor of the turbocharger depicted in FIG. 2.
Figure 4:
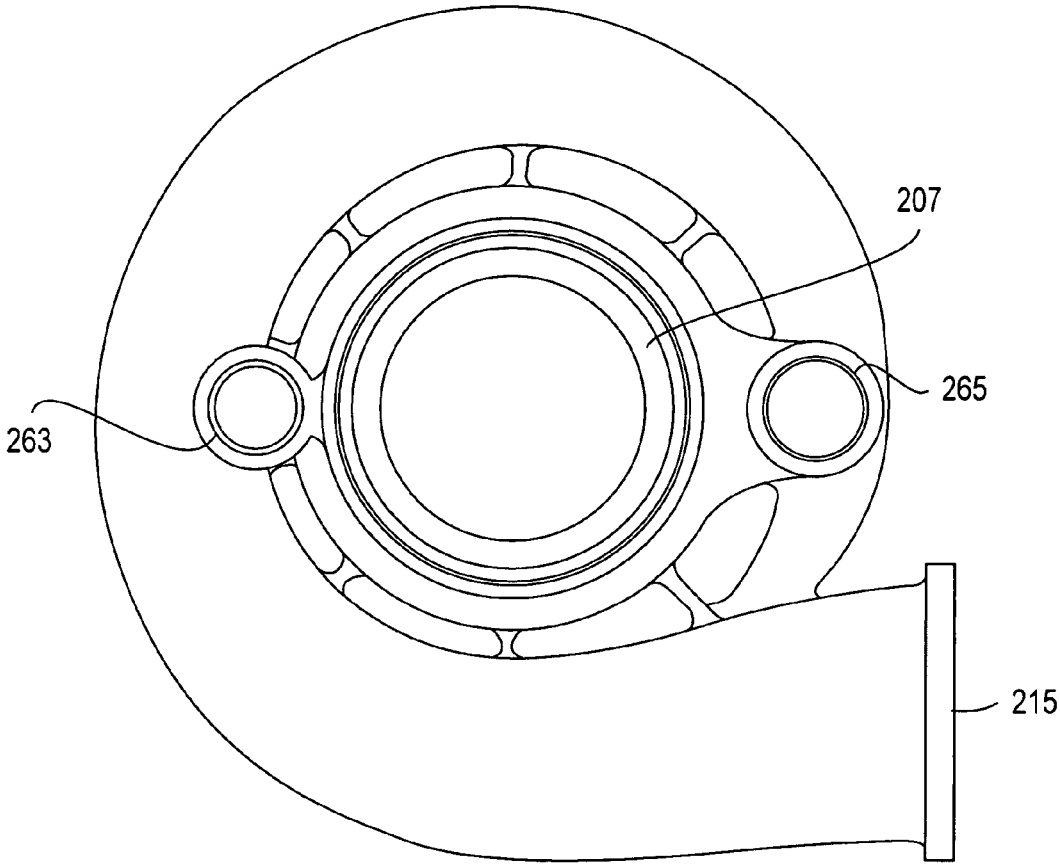
FIG. 4 is a right side view of the compressor depicted in FIG. 3.
Figure 5:
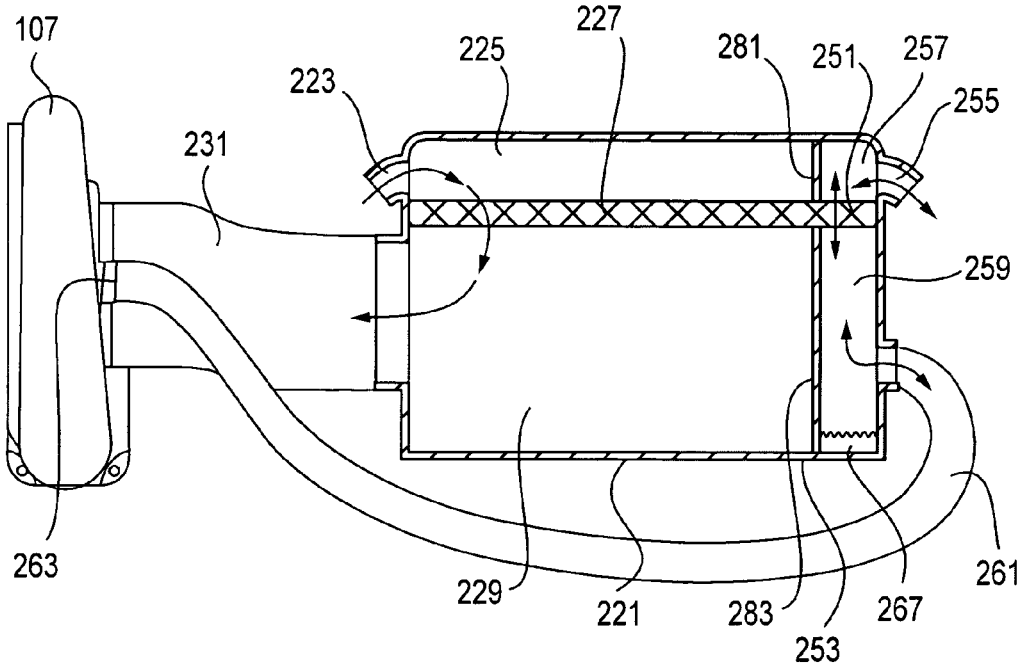
FIG. 5 is a front view of the compressor depicted in FIG. 2, along with an air filtration system under the invention.

With reference to FIG. 2, in a first embodiment of the invention, a turbocharger 101 includes a turbocharger housing and a rotor configured to rotate within the turbocharger housing along an axis of rotor rotation 103 on thrust bearings and journal bearings. The turbocharger housing includes a turbine housing 105, a compressor housing 107, and a bearing housing 109 that connects the turbine housing to the compressor housing. The rotor includes a turbine wheel 111 located substantially within the turbine housing, a compressor wheel 113 located substantially within the compressor housing, and a shaft 115 extending along the axis of rotor rotation, through the bearing housing, to connect the turbine wheel to the compressor wheel.

The turbine housing 105 and turbine wheel 111 form a turbine configured to circumferentially receive a high-pressure exhaust gas stream 121 from an exhaust manifold 123 of an internal combustion engine 125. The turbine wheel (and thus the rotor) is driven in rotation around the axis of rotor rotation 103 by the high-pressure exhaust gas stream, which becomes a lower-pressure exhaust gas stream 127 and is axially released into an exhaust system (not shown).

The compressor housing 107 and compressor wheel 113 form a compressor. The compressor wheel, being driven in rotation by the exhaust-gas driven turbine wheel 111, is configured to compress axially received ambient air 131 into a pressurized air stream 133 that is ejected circumferentially from the compressor. The pressurized air stream is characterized by an increased temperature, over that of the ambient air, due to the compression process, but may be channeled through a convectively cooled charge air cooler 135 configured to dissipate heat from the pressurized air stream, and thereby increase its density. The resulting cooled and pressurized air stream 137 is channeled into an intake manifold 139 on the internal combustion engine.

With reference to FIGS. 2 through 5, the compressor wheel 113 includes a plurality of blades 201 (i.e., impellers) that define an inducer 203 (i.e., a typically circular intake end of the combined set of blades) and an exducer 205 (i.e., a typically annular output end of the combined set of blades). The compressor housing and compressor wheel form an air passageway, serially including an intake port 207 leading axially into the inducer, an impeller passage 209 leading from the inducer to the exducer and substantially conforming to the space through which the blades rotate, a diffuser 211 leading radially outward from the exducer, and a volute 213 extending around the diffuser. The volute forms a scroll shape, and leads to an outlet port 215 through which the pressurized air stream is ejected circumferentially (i.e., normal to the circumference of the scroll at the exit) as the pressurized air stream 133 that passes to the (optional) charge air cooler and intake manifold. Each of these portions of the passage are in fluid communication with the next, and the intake port is in fluid communication with an ambient air source.

As is typical in automotive applications, the intake port 207 is fed external air from an intake passage in fluid communication with the external atmosphere. More particularly, the source of external air is an air filtration system serially including an intake-air filter housing 221 configured with an intake-air external vent 223 allowing external air into a first chamber 225 (formed within a ventilation compartment that also forms the external vent) of the intake-air filter housing, the air filtration system being configured to (and functioning to) pass the external air through an intake-air filter 227 to a second chamber 229 (formed within an internal compartment that forms a duct connector) of the intake-air filter housing, and then through a duct 231 (connected to the internal compartment duct connector) that connects to the compressor housing and is in fluid communication with the intake port 207. In order to pass the external air through the intake-air filter, the ventilation compartment and internal compartment each open up to opposing sides of the intake-air filter, and the filter housing is configured to seal to the filter such that substantially all air passing from the intake-air ventilation compartment to the intake-air internal compartment must pass through the intake-air filter.

The compressor housing further defines an annular bypass port 241 opening through a shroud 243 (i.e., a compressor housing wall immediately surrounding and substantially conforming to an outer boundary of the path through which the blades rotate) into the impeller passage 209 between the inducer and exducer, the bypass port placing the impeller passage in fluid communication with the external atmosphere. Similar to a traditional ported shroud, this bypass port improves the surge characteristics of the compressor by routing some air passing through the impeller passage out of the impeller passage during low-airflow operation, thereby extending the range over which the compressor can operate without experiencing a surge condition. However, rather than sending this heated compressor bypass flow back into the intake port during low-airflow operation (as is known for a typical ported shroud), this bypass flow is routed out of the compressor system to an external vent.

Also, similar to a traditional ported shroud, this bypass port may improve the choke characteristics of a compressor by providing an additional flow path into the impeller passage, without passing through the inducer, during high-airflow operation, thereby extending the range over which the compressor can operate without experiencing a choke condition. However, rather than drawing air from the flow entering the intake port, the bypass port provides a separate external air source for the additional flow.

These advantages, which are similar to those of a traditional ported shroud, are had without the systemic inefficiency of a traditional ported shroud. More particularly, the air that flows out of the bypass port, which has been heated by the work done upon it by the impellers, flows out of the compressor system rather than back to the compressor intake port (or earlier in the intake passage) through the second passageway. Thus, the outgoing heated bypass flow does not increase the temperature of air entering the inducer, does not increase the work needed from the turbine to compress the air, and thereby does not reduce the compressor efficiency.

For many applications, such as automotive applications, it is unlikely that the free venting of impellor passage air, which may contain small quantities of lubricant or other contaminants, will typically be acceptable. Moreover, it is not desirable for the compressor to compress unfiltered air from the bypass port, or to pass that unfiltered air on to the intake manifold. Therefore, this embodiment further includes a filter adapted to filter air passing between the impeller passage and the atmosphere via the bypass port.

More particularly, the filtration system includes a bypass-air filter 251 provided in a bypass-air filter housing 253, which is connected to the bypass port 241 via a bypass-air passage. To be the source of external air for the bypass port, the bypass-air filter housing is serially configured with a bypass-air external vent 255 allowing external air into and out of a first bypass-air chamber 257 (formed by a ventilation compartment that also forms the external vent) of the bypass-air filter housing. The air filtration system is configured to pass the external air through the bypass-air filter 251 between a second bypass-air chamber 259 (formed within an internal compartment that forms a hose connector) of the bypass-air filter housing, and a hose 261 (connected to the internal compartment hose connector) that connects to a bypass-hose connection 263 on the compressor housing 107. The depicted hose size does not necessarily reflect an appropriate size for any given system, and the proper hose (and related opening) size should be determined on a system-by-system basis (e.g., experimentally).

In order to pass the air through the bypass-air filter, the ventilation compartment and internal compartment each open up to opposing sides of the bypass-air filter, and the filter housing is configured to seal to the filter such that substantially all air passing between the bypass-air ventilation compartment and the bypass-air internal compartment must pass through the bypass-air filter. Thus, the bypass-air filter both filters external air being drawn in through the bypass vent (preventing atmospheric dirt from entering the system via the bypass vent) and bypass vent air expelled into the atmosphere (preventing compressor lubricants and contaminants from expelling into the external engine compartment and atmosphere). The internal compartment is configured to form a reservoir to collect a pool 267 of fluids and/or particulate matter filtered from air received from the bypass vent.

The bypass-hose connection opens into an annular bypass chamber 271 of the compressor housing, placing the bypass-air filter portion in fluid communication with the bypass port 241. The manufacture of a compressor housing with a bypass chamber and bypass-hose connection is further described in U.S. application Ser. No. 10/430,467, filed May 5, 2003, published in Patent Publication No. 2004/0223843 A1, on Nov. 11, 2004, which is incorporated herein by reference for all purposes. More particularly, that publication discusses the use of a second opening 265 to aid in the manufacture of the compressor housing.

To provide for the present embodiment to be cost, weight and space efficient, the intake-air filter 227 used for filtering intake air (entering the intake passage) is preferably unitary with the bypass-air filter 251 (as depicted), thus becoming an intake-air filter portion and a bypass-air filter portion of a unitary air filter, the two portions preferably being exclusive from one another. Likewise, the intake-air filter housing 221 is preferably unitary with the bypass-air filter housing 253, thus becoming an intake-air housing portion and a bypass-air housing portion of a filter housing. Alternatively, separate intake-air and bypass-air filters could reside in separate intake-air and bypass-air filter housings.

The intake-air and bypass-air chambers of the filter housing are substantially not in direct fluid communication with each other (i.e., they are not in fluid communication other than via an indirect path through the external atmosphere, or through minor structural imperfections within the filter housing or the filter). Preferably, the first external vent and second external vent are separate vents, and are faced away from each other and/or separated by a distance adequate to prevent a substantial flow rate between the intake-air and bypass-air first chambers. The second intake-air chamber is in fluid communication with the impeller passage only via the inducer, and therefore is in direct fluid communication with the impeller passage without extending through the bypass-air passage. The second bypass-air chamber is in fluid communication with the impeller passage only via the bypass-air port, and therefore is in direct fluid communication with the impeller passage without extending through the intake passage.

The filter housing is configured to connect to the filter so as to minimize any possible airflow between the intake-air chambers and the bypass-air chambers through the filter itself. This may be done, for example, by having first housing walls 281 and second housing walls 283 between the first chambers and between the second chambers, respectively, of the filter housing. The housing walls are configured to press into the filter on opposing sides. As a result, the filter housing is configured to separate air exiting the bypass-air portion of the filter from air entering the intake-air portion of the filter, and vise versa.

It is to be understood that the invention further comprises related apparatus and methods for designing turbocharger systems and for producing turbocharger systems, as well as the apparatus and methods of the turbocharger systems themselves. In short, the above disclosed features can be combined in a wide variety of configurations within the anticipated scope of the invention.

While particular forms of the invention have been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. An apparatus, for use with a turbocharger having a compressor wheel including blades that define an inducer and an exducer, an intake-air air filter, and a body forming an intake air passage extending from the intake-air filter to the inducer and placing the intake-air air filter in direct fluid communication with the inducer, comprising:

a compressor housing configured to receive the wheel, wherein the compressor housing defines an impeller passage within which air is to be compressed by the blades, and a bypass port opening into the impeller passage between the inducer and exducer, wherein the bypass port forms a passage leading between the impeller passage and the atmosphere without extending through the intake air passage; and a filter adapted to filter air passing between the bypass port and the atmosphere.

2. A turbocharger, comprising:

a compressor wheel having blades that define an inducer and an exducer;

the apparatus of claim 1; and a turbine configured to drive the compressor wheel within the compressor housing.

3. The apparatus of claim 1, and further comprising a filter housing, wherein:

the filter housing defines an intake-air internal compartment that opens up to an intake-air filter portion of the filter, the intake-air internal compartment forming an intake-air chamber in direct fluid communication with the impeller passage;

the filter housing defines a bypass-air internal compartment that opens up to a bypass-air filter portion of the filter exclusive from the intake-air portion of the filter, the bypass-air internal compartment forming a bypass-air chamber in direct fluid communication with the bypass port; and the intake-air and bypass-air chambers are not substantially in direct fluid communication.

4. A turbocharger, comprising:

a compressor wheel having blades that define an inducer and an exducer;

the apparatus of claim 3; and a turbine configured to drive the compressor wheel within the compressor housing.

5. The apparatus of claim 3, wherein the filter housing is further configured to form intake-air and bypass-air ventilation compartments on opposite sides of the filter from the intake-air and bypass-air internal compartments, respectively, and wherein the ventilation compartments are configured with separate vents configured to prevent a substantial flow between the chambers of the intake-air and bypass-air ventilation compartments.

6. The apparatus of claim 5, wherein the vents separated by a distance adequate to prevent a substantial flow between the chambers of the intake-air and bypass-air ventilation compartments.

7. A turbocharger, comprising:

a compressor wheel having blades that define an inducer and an exducer;

the apparatus of claim 6; and a turbine configured to drive the compressor wheel within the compressor housing.

8. A compressor system for use in a turbocharger, comprising:

a compressor wheel having blades that define an inducer and an exducer; and the apparatus of claim 1.

9. A method for improving the efficiency of a turbocharger including a compressor wheel having blades that define an inducer and an exducer, and further including a compressor housing configured to receive the wheel, comprising:

venting air out of a compressor housing impeller passage, within which the wheel spins to compress air, via a bypass port opening into the impeller passage between the inducer and exducer, to the atmosphere such that the vented air does not interact with intake air being routed through an intake port to the inducer.

10. The method of claim 9, wherein the step of venting includes a step of filtering air passing between the impeller passage and the atmosphere via the bypass port.

11. The method of claim 10, wherein:

intake air being routed through the intake port to the inducer is passed through a first portion of a filter; and the step of filtering includes passing the passed air through a second portion of the filter.

12. The method of claim 11, and further comprising separating atmospheric airflows on an atmospheric side of the filter such as to prevent a substantial flow rate between air exiting via the second portion of the filter and air entering via the first portion of the filter.

13. A turbocharger, comprising:

a compressor wheel having blades that define an inducer and an exducer;

a compressor housing configured to receive the wheel; and a means for venting air out of a compressor housing impeller passage, within which the wheel spins to compress air, via a bypass port opening into the impeller passage between the inducer and exducer, to the atmosphere such that the vented air does not interact with intake air being routed through an intake port to the inducer;

wherein the means for venting includes a means for filtering air passing between the impeller passage and the atmosphere via the bypass port;

wherein the means for filtering is configured such that intake air being routed through the intake port to the inducer is passed through a first portion of a filter; and wherein the means for filtering is further configured such that bypass air being vented from the impeller passage via the bypass port passes through a second portion of the filter.

14. The turbocharger of claim 13, and further comprising a means for separating atmospheric airflows on an atmospheric side of the filter such as to prevent a substantial flow rate between air exiting via the second portion of the filter and air entering via the first portion of the filter.

15. An apparatus, for use with a turbocharger having a compressor wheel including blades that define an inducer and an exducer, comprising:

a compressor housing configured to receive the wheel, wherein the compressor housing defines an impeller passage within which air is to be compressed by the blades, an intake port configured to provide intake air to the inducer, and a bypass port opening into the impeller passage between the inducer and exducer, the bypass port placing the impeller passage in fluid communication with the atmosphere without extending through an intake air passage;

a filter adapted to filter air passing between the bypass port and the atmosphere; and a filter housing;

wherein the filter housing defines an intake-air internal compartment that opens up to an intake-air filter portion of the filter, the intake-air internal compartment forming an intake-air chamber in direct fluid communication with the impeller passage;

wherein the filter housing defines a bypass-air internal compartment that opens up to a bypass-air filter portion of the filter exclusive from the intake-air portion of the filter, the bypass-air internal compartment forming a bypass-air chamber in direct fluid communication with the bypass port; and wherein the intake-air and bypass-air chambers are not substantially in direct fluid communication.

16. An apparatus, for use with a turbocharger having a compressor wheel including blades that define an inducer and an exducer, an intake-air air filter, and a body forming an intake air passage placing the intake-air air filter in direct fluid communication with the inducer, comprising:

a compressor housing configured to receive the wheel, wherein the compressor housing defines an impeller passage within which air is to be compressed by the blades, and a bypass port opening into the impeller passage between the inducer and exducer;

a filter; and a filter housing;

wherein the bypass port forms a passage leading between the impeller passage and the atmosphere without extending through the intake air passage;

wherein the filter is adapted to filter air passing between the bypass port and the atmosphere;

wherein the filter housing defines an intake-air internal compartment that opens up to an intake-air filter portion of the filter, the intake-air internal compartment forming an intake-air chamber in direct fluid communication with the impeller passage;

wherein the filter housing defines a bypass-air internal compartment that opens up to an intake-air filter portion of the filter exclusive from the intake-air portion of the filter, the bypass-air internal compartment forming a bypass-air chamber in direct fluid communication with the bypass port; and wherein the intake-air and bypass-air chambers are not substantially in direct fluid communication.

17. A turbocharger, comprising:

a compressor wheel having blades that define an inducer and an exducer;

the apparatus of claim 16; and a turbine configured to drive the compressor wheel within the compressor housing.

18. The apparatus of claim 16, wherein the filter housing is further configured to form intake-air and bypass-air ventilation compartments on opposite sides of the filter from the intake-air and bypass-air internal compartments, respectively, and wherein the ventilation compartments are configured with separate vents configured to prevent a substantial flow between the chambers of the intake-air and bypass-air ventilation compartments.

19. The apparatus of claim 18, wherein the vents separated by a distance adequate to prevent a substantial flow between the chambers of the intake-air and bypass-air ventilation compartments.

20. A turbocharger, comprising:

a compressor wheel having blades that define an inducer and an exducer;

the apparatus of claim 19; and a turbine configured to drive the compressor wheel within the compressor housing.

21. A method for improving the efficiency of a turbocharger including a compressor wheel having blades that define an inducer and an exducer, and further including a compressor housing configured to receive the wheel, comprising:

venting air within a compressor housing impeller passage, within which the wheel spins to compress air, via a bypass port opening into the impeller passage between the inducer and exducer, to the atmosphere such that the vented air does not interact with intake air being routed through an intake port to the inducer;

wherein the step of venting includes a step of filtering air passing between the impeller passage and the atmosphere via the bypass port.

22. The method of claim 21, wherein:

intake air being routed through the intake port to the inducer is passed through a first portion of a filter; and the step of filtering includes passing the passed air through a second portion of the filter.

23. The method of claim 22, and further comprising separating atmospheric airflows on an atmospheric side of the filter such as to prevent a substantial flow rate between air exiting via the second portion of the filter and air entering via the first portion of the filter.

24. A turbocharger, comprising:

a compressor wheel having blades that define an inducer and an exducer;

a compressor housing configured to receive the wheel; and a means for venting air in a compressor housing impeller passage, within which the wheel spins to compress air, via a bypass port opening into the impeller passage between the inducer and exducer, to the atmosphere such that the vented air does not interact with intake air being routed through an intake port to the inducer;

wherein the means for venting includes a means for filtering air passing between the impeller passage and the atmosphere via the bypass port;

wherein the means for filtering is configured such that intake air being routed through the intake port to the inducer is passed through a first portion of a filter; and wherein the means for filtering is further configured such that bypass air being vented from the impeller passage via the bypass port passes through a second portion of the filter.

25. The turbocharger of claim 24, and further comprising a means for separating atmospheric airflows on an atmospheric side of the filter such as to prevent a substantial flow rate between air exiting via the second portion of the filter and air entering via the first portion of the filter.

* * * * *